US007905816B1

(12) United States Patent
Murphy

(10) Patent No.: US 7,905,816 B1
(45) Date of Patent: Mar. 15, 2011

(54) ADJUSTABLE EXERCISE APPARATUS

(76) Inventor: G. Lane Murphy, Boston, MA (US)

( * ) Notice: Subject to any disclaimer, the term of this patent is extended or adjusted under 35 U.S.C. 154(b) by 50 days.

(21) Appl. No.: 12/565,195

(22) Filed: Sep. 23, 2009

(51) Int. Cl.
*A63B 21/00* (2006.01)

(52) U.S. Cl. ..... 482/49; 482/35; 482/114

(58) Field of Classification Search ..... 482/35–42, 482/140, 141, 130, 23, 16, 17, 115, 118, 482/49, 114
See application file for complete search history.

(56) References Cited

U.S. PATENT DOCUMENTS

| | | | | |
|---|---|---|---|---|
| 4,232,863 | A | 11/1980 | Roach | |
| 4,351,525 | A | 9/1982 | Rozenblad | |
| D290,033 | S * | 5/1987 | Policastro | D21/691 |
| 4,826,151 | A | 5/1989 | Nuredin | |
| 4,854,573 | A | 8/1989 | Johannson et al. | |
| 4,923,194 | A | 5/1990 | Montgomery | |
| D317,031 | S * | 5/1991 | Ceppo | D21/691 |
| 5,181,897 | A | 1/1993 | Agan | |
| 5,205,802 | A | 4/1993 | Swisher | |
| 5,226,868 | A | 7/1993 | Montgomery | |
| 5,330,408 | A | 7/1994 | Westmoreland | |
| 5,527,252 | A | 6/1996 | Sather | |
| 5,697,875 | A | 12/1997 | Stan | |
| 5,749,818 | A | 5/1998 | Sather | |
| 6,129,651 | A | 10/2000 | Denaro | |
| 6,159,111 | A * | 12/2000 | Purcell | 473/422 |
| 6,190,293 | B1 | 2/2001 | Schuyler et al. | |
| 6,409,640 | B2 | 6/2002 | Cournoyer | |
| 6,471,623 | B1 | 10/2002 | Lin | |
| D480,772 | S * | 10/2003 | Washington | D21/686 |
| 6,663,547 | B1 | 12/2003 | Hughes | |
| 7,060,014 | B2 | 6/2006 | Bergman et al. | |
| D579,503 | S | 10/2008 | Hauser et al. | |
| 7,468,025 | B2 | 12/2008 | Hauser et al. | |

* cited by examiner

*Primary Examiner* — Jerome Donnelly

(57) ABSTRACT

Provided is exercise equipment for performing a variety of exercises for upper body exercises such as push-up, pull-up, and dip styles of exercise as well as core strengthening exercises. In some embodiments, the device allows for vertical and horizontal adjustments to a variety of positions allowing for general use for persons of all sizes and levels of abilities, from the beginner to the highly experienced and athletic person.

6 Claims, 6 Drawing Sheets

ADJUSTABLE EXERCISE APPARATUS

FIELD OF THE INVENTION

Embodiments of the present invention relates to exercise equipment for performing a variety of exercises. More particularly, some embodiments of the present invention relate to exercise equipment for performing a variety of upper body exercises such as push-up, pull-up, and dip styles of exercise as well as core strengthening exercises. In some embodiments, the device allows for vertical adjustments to a variety of positions allowing for general use for persons of all levels of abilities, from the beginner to the highly experienced and athletic person.

BACKGROUND OF THE INVENTION

Montgomery, in U.S. Pat. No. 4,923,194, describes an exercise device with a crossbar that is rigidly bent to a predetermined configuration. The bar can be vertically adjusted using springs with rubberized portions using friction to hold the bar in place. As can be appreciated rubber can wear out and coefficients of friction can change over time and with varying loads. As a result the integrity of the adjustment and safety can be jeopardized. The cross-bar can not be adjusted lengthwise to allow for wider or smaller arm span nor can the grip portion of the bar be adjusted to allow for personal preference or to alter the exercise. The device takes up a lot of space as folding for easy storage is not provided.

A push-up apparatus described in U.S. Pat. No. 5,205,802 provides for a pair of handles that are able to rotate in a circle around an axis perpendicular to the floor in an attempt to ease the tension provided on the hands, wrists, and arms. It also provides the user the ability to change the width between the two handles to allow for various sized users. The device does not allow for vertical adjustments and thus is not suitable for a beginner or for users with varying abilities. The handles are freely rotatable which may result in instability of the hands and arms during the exercise.

The apparatus described above are designed only for push-up exercises. As can be ascertained from the above discussion, there remains a need for an exercise device that, for example, a) allows for more than one exercise, b) allows vertical adjustability to positions that allow persons of various abilities to perform the exercise, c) allows for handle adjustments that, once set, can be held in place, d) is adjustable widthwise to allow arm span adjustments and/or e) can be folded to provided for easy storage.

SUMMARY OF THE INVENTION

Embodiments of the present invention provide an exercise apparatus for performing upper body exercises such as pull-ups, push-ups, and dips and is adaptable for core strengthening exercises such as sit-ups, crunches, side-bends, and back-bends. In some embodiments of the present invention, the apparatus is adjustable so that users of differing abilities can benefit from exercising with the apparatus. Alternatively or additionally, some embodiments of the present invention are foldable for easy storage. Various embodiments of the present invention are described below. It will be understood that one embodiment of the present invention is a device having all of the features described herein. In other embodiments, a device having a subset (e.g., one or more) of the described features may be provided without departing from the present invention.

In some embodiments, the apparatus is made up of a base crossbar which is adjustable lengthwise, and which is attached to the center of a pair of floor-bars to form a base, the base being adapted to lie on the floor. Each floor bar may be optionally bisected for folding for storage. The floor bars may be perpendicular to the crossbar or may be angled.

In some embodiments, when the floor bar is bisected for folding, the two segments of the floor bar are placed in a bracket which is permanently attached to the cross-bar. The bracket also has a sleeve into which the vertical bars are permanently attached. During use, the segments lock into place in the cradle using a locking mechanism as described below, which provides stability to the exercise device. When folding the floor bars for storage the locking mechanism is removed and the segments are free to fold.

According to some embodiments of the present invention, attached to the center of the pair of floor bars is a pair of upright vertical bars which are aligned perpendicular to both the floor bars and the crossbar.

In some embodiments, the apparatus is equipped with a pair of hand grips which can slide along the pair of vertical bars and be incrementally positioned thereon. The positions are set using a locking mechanism such as, for example, locking pins which are inserted into and through a pair of aligned, prefabricated apertures in the pair of vertical bars such that the apertures are equi-positioned along the bar so that when the grips are locked they are parallel to a base. Other examples of suitable locking mechanisms include screw locks and lever locks. The apertures are further aligned between the pair of vertical bars so that, when positioned, the hand grips are parallel to the floor.

In accordance with some embodiments of the present invention, by incrementally adjusting the hand grips along the vertical axes of the vertical bar, in order to raise and lower them, the exercise can be made more or less difficult depending on the ability of the user. When positioned high on the vertical bar, the push-up or pull-up is relatively easy. By incremental positioning of the hand grips to lower positions, the exercise becomes incrementally more difficult. As a user becomes more proficient, the grips can be positioned to allow for more strenuous exercising. The reverse is the case with dip-style exercises, that is, at lower positioning of the hand-grips the exercise is easier than at higher positions.

In some embodiments, the base cross-bar can be incrementally adjusted to increase or decrease the distance between the pair of bars and consequently the distance between the hand grips. Here again the positions are set by a locking mechanism on the base cross-bar as described above.

In some embodiments, the gripping portion of the hand grip may be permanently attached to the hand grip body and in a variety of preselected positions or, to further accommodate users of varying abilities, the hand grips may be rotatably positioned to allow for more or less difficulty in the exercise. Rotatable hand grips can be locked into a selected position so as not to rotate during the exercise using a locking mechanism as described above, or they may lock during use. In this case, when pressing down on the gripping portion during the exercise the gripping portion of the hand grip engages with the hand grip body and thereby locks it in place.

In another aspect according to some embodiments of the invention, the hand grips may be replaced by a cross-bar which spans the two vertical bars. The ends of the bar are incrementally positioned along a pair of vertical bars in a fashion similar to the pair of hard grips. The cross bar can be used for gripping along its length to allow for push-ups and pull-ups.

In a further aspect according to some embodiments of the invention, the cross-bar is padded with materials which allow for the torso to put pressure on it, such as for example when bending over the bar, and remain relatively comfortable when performing such an act. Additionally, some embodiments of the invention include a foot-cross-bar attached to the ends of the optionally segmented floor-bars. The foot-cross-bar may also be padded for comfort and ease of use. Upon attachment of both the cross-bar and the foot-cross-bar, the device can be used for, for example, core strengthening exercises (e.g., lower back extensions). When the floor-bars are segmented they can be bent up to allow for easy storage.

DETAILED DESCRIPTION OF THE INVENTION

Figure 1:
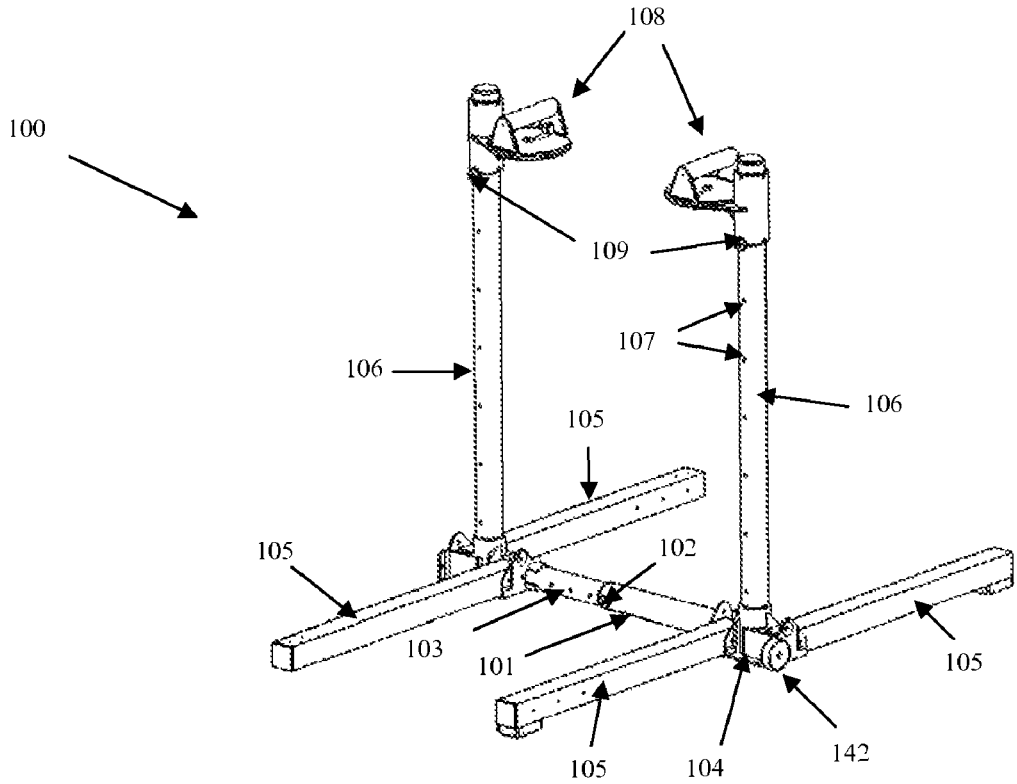
FIG. 1 is a perspective view of one aspect of the exercise device 100 in accordance with an example embodiment.

For the purpose of illustrating some embodiments of the invention, there is shown in the accompanying drawings several preferred embodiments of the present invention. It is to be understood that the invention is not intended to be limited to the precise arrangements and instrumentalities shown. The example embodiments will become more fully understood from the detailed description given herein below and the accompanying drawings, wherein like elements are represented by like reference numerals, which are given by way of illustration only and thus the present invention is not limited by the examples.

Turning now to FIG. 1, an exercise device 100 includes a base crossbar 101 which is adjustable lengthwise. One method to adjust the crossbar is shown in FIG. 1 in which the crossbar comprises two sections, one section being smaller than the other section and thereby fitting slideably into the other section. The two sections are held in place by a securing mechanism, such as, for example, a locking pin, as depicted by 102 in FIG. 1. Adjustments are made lengthwise, and locking in place is maintained using apertures 103 incrementally placed along the axis of the thinner section that slides into and out of the outer section. An aperture is provided in the thicker section of the crossbar which can align with the apertures of the thinner section to allow the locking mechanism to secure the two sections. The outer ends of the base crossbar are each securely attached to a bracket 104. Also attached to the brackets 104 are floor bars 105. The floor bars are pivotally attached to the brackets using a pivot. In use, the four floor bar sections are securely attached to the brackets in a fixed position. When not in use the floor bars are unsecured and folded up vertically while their ends are still attached to the brackets. Also securely attached to the brackets is a pair of vertical bars 106 which contain apertures 107 incrementally placed along the axis of the bars for adjustments. Slideably attached to the vertical bars are one or more holding devices, such as, for example, hard grips 108 shown in the figure. The hand grips are comprised of a collar that fits around the vertical bars and slides up and down the axis of the bars. The collar contains niches on opposite sides of the collar to allow a locking mechanism 109 to secure the collar and hand grips to the vertical bars, the niches in the collar aligning with the apertures in the bars. Other device(s), such as a slideably attached crossbar could also be used in some embodiments of the current invention. The height of the hand grips is achieved by removing the locking mechanism, sliding the collar of the hand grip up or down the length of the vertical bar until a desired incremental height is reached, and then replacing the locking mechanism.

Figure 2:
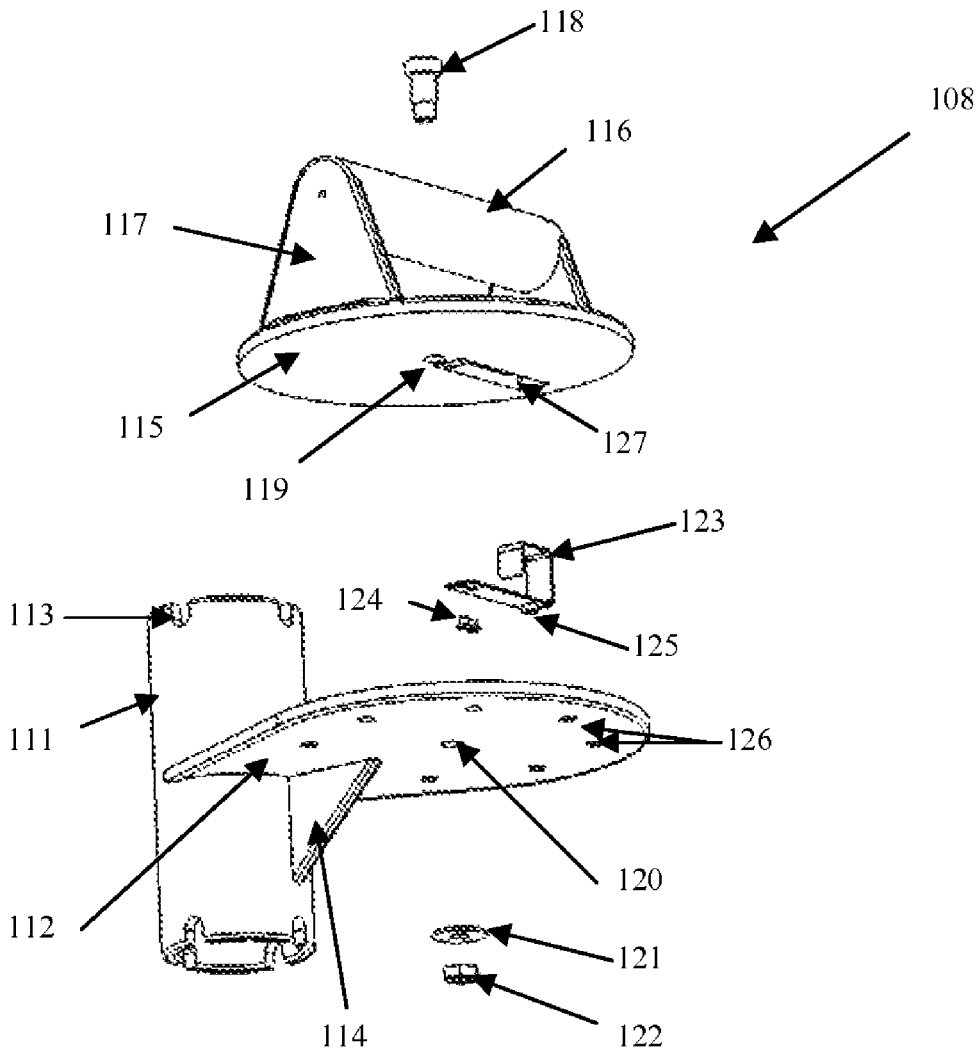
FIG. 2 is an exploded view of a rotatable hand-grip 108.

An exploded view of a rotatable hand grip 108 is shown in FIG. 2. Securely attached to (e.g., integrally formed with) the collar 111 is a base 112 and in the collar are niches 113 for securing the hand grips on the vertical bars. For increased strength a brace 114 is attached under the base and attached to the collar. The rotating portion of the hand grip is a rotatable base 115 with a gripping bar 116 securely attached horizontally to two vertical brackets 117 which are in turn attached securely to the rotatable base. The rotatable portion of the hand grip 115 is held in place on (albeit capable of rotation on) the base 111 using a pivot pin 118 placed through a pivot hole 119 in the rotating base and through a pivot hole 120 in the base 111. The pin is held in place by a washer 121 and a nut 122. The pivot pin 118 is threaded only on the end to receive the nut. This configuration allows the rotatable portion of the grip 118 to securely rotate around the pivot pin 118 on top of the base 111 without sliding off the base. Attached to the rotatable base 115, using an attaching device 124 such as a screw, is a securing mechanism 123 which prevents rotation of the rotatable base 115 relative to the base 112 when the device is in use. The mechanism has a nipple device 125 on the bottom of the securing mechanism which locks into a prefabricated arrangement of niches 126 in the base 112. The securing mechanism 123 is fitted through a slot 127 in the rotatable base 115. During use the securing mechanism 123 is lifted through the slot 127 in the rotatable base to allow free movement of the rotatable portion of the hand grip to rotate to a desired position and then released to engage the nipple device into the niche and thus a locked position. The gripping portion of the hand-grip, the gripping bar 116, may be covered with pliable material for gripping comfort, such as rubber or rubbery covering or a tape which is pliable or other pliable polymer coating. The collar 111 fits snuggly over the vertical beams so that the collar can easily slide up and down the beam for adjustability but is tight enough to allow for very little or no movement of the collar during use in exercising once the collar and hence the hand grip is secured in place.

Figure 3:
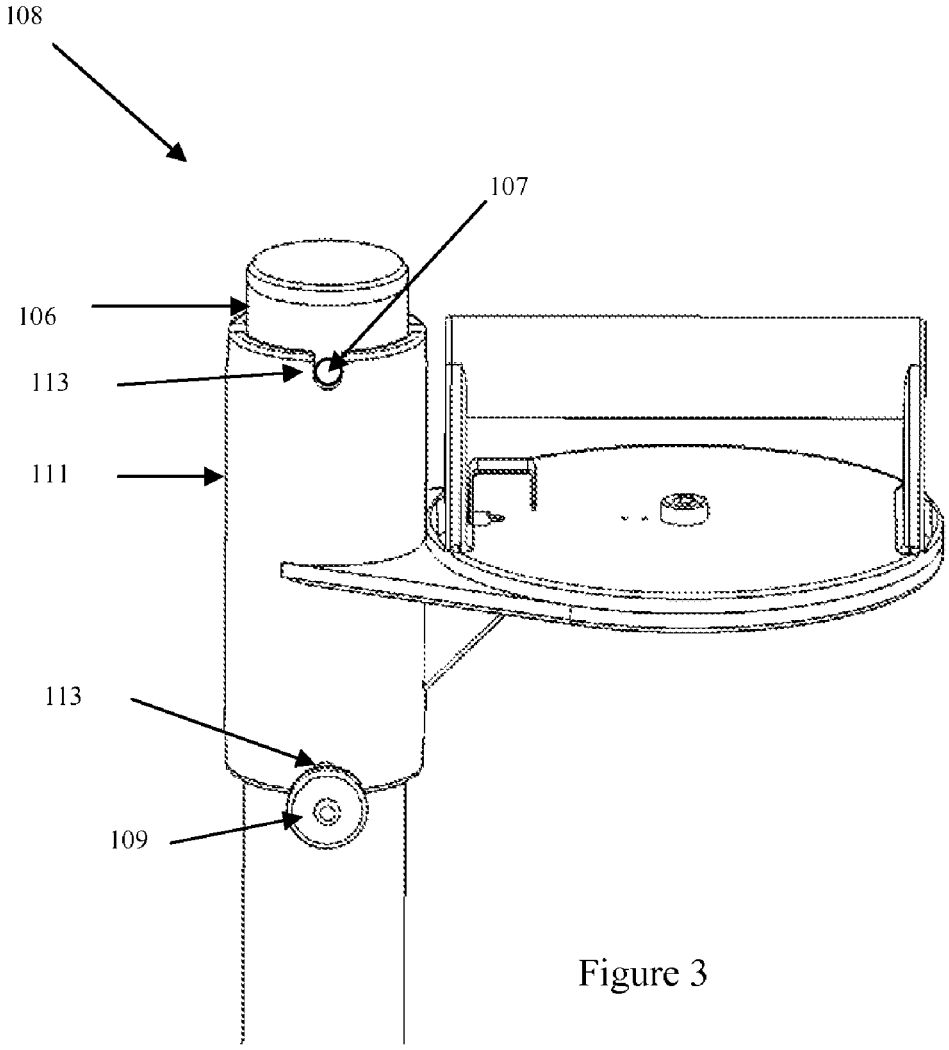
FIG. 3 is a view of the hand grip positioned on the vertical bar.

A view of the hand grip 108 in use is shown in FIG. 3. As can be seen the hand grip collar 111 is slideably attached to the vertical bar 106 using a locking mechanism 109, in this case a locking pin, which is positioned through apertures 107 in the vertical bar and also aligned with the niches 113 of the hand grip collar. In some embodiments of the present invention, each collar 111 may have four niches positioned respectively at 90, 180, 270, and 360 degrees around the circumference of each end of the collar to allow for various corresponding positions of the hand grips 108 during use.

Figure 4:
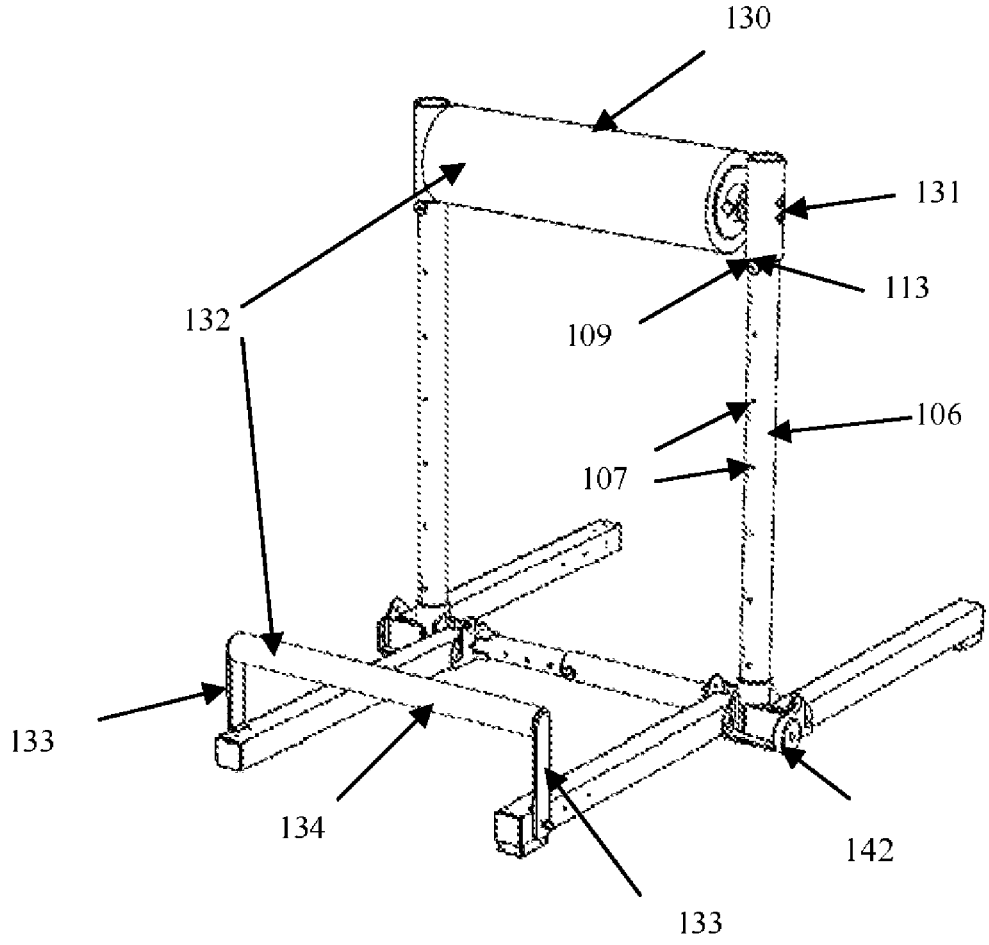
FIG. 4 is a perspective view of another aspect of the exercise device in accordance with an example embodiment.

In FIG. 4 a first crossbeam 130 is slideably attached to the vertical bars. The first crossbeam is securely attached to collars 131 that fit around the vertical bars 106 and slide up and down the axes of the vertical bars. Each collar contains niches 113 on opposite sides of the collar to allow a locking mechanism 109 to secure the collar and first crossbeam to the vertical bars, the niches in the collar aligning with apertures 107 in the vertical bars. The first crossbeam is covered with padding 132. Attached to the end of one pair of half beams of the floor bars is a set of brackets 133 to which is attached a second crossbeam 134 also covered with padding 132. The second crossbeam and brackets are arranged so that the first and second crossbeams are parallel. In use, the first crossbeam slide up and down the vertical bars until a desired position is reaches and the locking mechanism is engaged.

Figure 5:
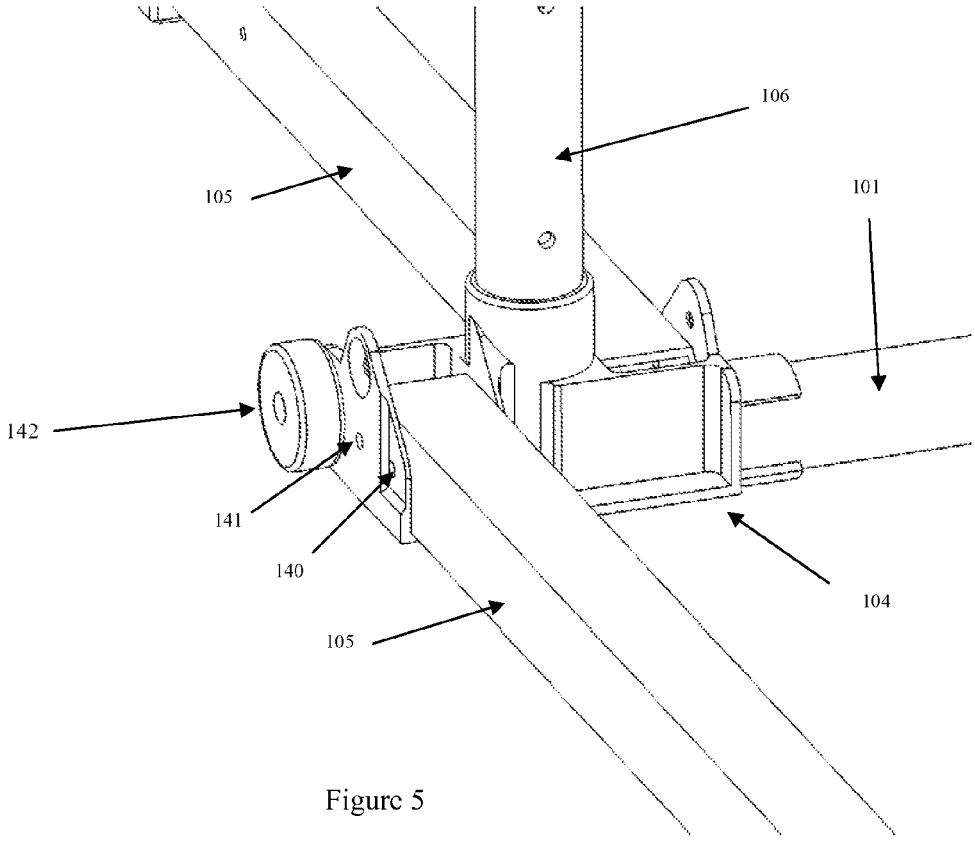
FIG. 5 is a view of a bracket during use in exercising.

In FIG. 5 a bracket 104 is shown to which the base crossbeam 101, the vertical bar 106 and the half beams of the floor bars 105 are attached. The position of the floor bars as shown as they would be deployed during use, that is, they are extended outward and securely locked in place using a locking mechanism 140 as described herein to provide for stability. The half beams of the floor bars are also pivotally attached to the bracket using a secured pivot pin 141. The configuration shown in FIG. 5 may be particularly suited for, for example, core strengthening exercises including abdominal crunches and lower-back extensions.

Figure 6:
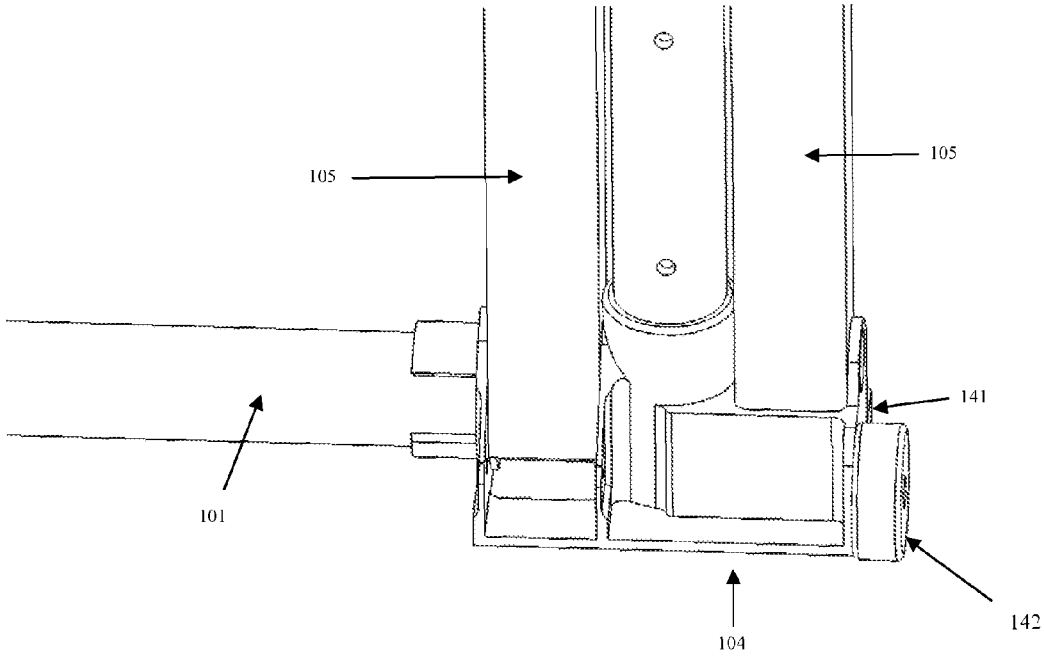
FIG. 6 is a view of a bracket when not in use in exercising and folded for storage.

In FIG. 6 a bracket 104 is shown wherein the half beams of the floor bars 105 are disengaged from their locked stability position and folded up by pivoting around pivot pins 141 to allow for storage. When folded the exercise apparatus is essentially flat and easily storable. As shown in FIGS. 1, 4, 5, and 6, also attached to each bracket 104 may be a wheel or other roller mechanism 142 for allowing ease of transport of the device when floor bars 105 are in the folded position.

In a further embodiment the hand grips may be turned upside down (relative to their positioning shown in FIGS. 1 and 3) and slideably attached to the vertical bars. As shown in FIGS. 1, 2, and 3, there are niches 113 on both ends of the collar to accommodate two positions of the hand grip, when the hand grips are in use. In one position the hand grips are on top and push-ups and dips can be performed. In the other, reverse position, pull-ups can be performed.

I claim:

1. An exercise device, comprising:

a. an adjustable crossbeam having first and second ends, the first end securely attached to substantially the center of a first floor bar and the second end securely attached to substantially the center of a second floor bar, forming a base, b. first and second substantially vertical beams, the first beam having an end securely attached to the center of the first floor bar and the second beam having an end securely attached to substantially the center of the second floor bar, the first and second vertical beams positioned substantially perpendicular to the base and essentially parallel to each other, and c. a gripping mechanism fitted over the first and second vertical beams which is capable of being adjusted substantially vertically along axes of the vertical beams, wherein the gripping mechanism comprises:

a first collar that fits over the first vertical beam and a second collar that fits over the second vertical beam, wherein notches are incrementally positioned around the top and bottom of each collar, and wherein the notches are configured for alignment with apertures that are positioned on the substantially vertical beams to which the gripping mechanism is slideably attached, wherein the crossbeam is adjustable to increase or decrease the distance between the substantially vertical beams.

2. The exercise device of claim 1, wherein:

a. the first end of the crossbeam is securely attached to a first bracket and the second end of the crossbeam is securely attached to a second bracket, b. each of the first and second floor bars comprises two half beams, wherein each of the first and second half beams of the first floor bar is attached to the first bracket at one end and each of the first and second half beams of the second floor bar is attached to the second bracket at one end, and wherein each half beam is configured for arrangement substantially perpendicular to and in the same plane as the crossbeam in a first configuration of the device, and c. the end of the first vertical beam which is securely attached to substantially the center of the first floor bar is securely attached to the first bracket and the end of the second vertical beam which is securely attached to substantially the center of the second floor bar is securely attached to the second bracket, wherein the substantially vertical beams extend substantially perpendicularly to the half beams and the crossbeam in the first configuration of the device, wherein the half beams are foldable to become substantially parallel to the vertical beams in a second configuration of the device.

3. The exercise device of any of claims 1 or 2, wherein the gripping mechanism comprises a pair of slideably adjustable hand grips.

4. The exercise device of claim 3, wherein each hand-grip is capable of being rotationally adjusted and locked into a plurality of rotational positions.

5. The exercise device of claim 4, wherein the gripping portion of each hand-grip is covered with a pliable material for gripping comfort.

6. The exercise device of claim 5, further comprising a padded stationary substantially horizontal bar attached to an end of each of two half beams and substantially perpendicular to the crossbeam.

* * * * *